United States Patent [19]

Breen

[11] Patent Number: 4,512,595

[45] Date of Patent: Apr. 23, 1985

[54] TAMPER-RESISTING NEGOTIABLE INSTRUMENTS CONTAINING A TRANSPARENT VERIFYING WEB

[75] Inventor: Thomas J. Breen, Arlington Heights, Ill.

[73] Assignee: Rand McNally & Company, Skokie, Ill.

[21] Appl. No.: 425,064

[22] Filed: Sep. 30, 1982

[51] Int. Cl.[3] ..... B42D 15/00; B41L 1/00; B41L 3/00; B41M 3/12

[52] U.S. Cl. ..... 283/70; 282/28 R; 282/22 R; 427/153

[58] Field of Search ..... 282/22 R, 28 R, 27 R, 282/26, 25, 2, 3; 427/153; 428/207; 283/70, 62, 61; 281/2, 5

[56] References Cited

U.S. PATENT DOCUMENTS

| | | | |
|---|---|---|---|
| 3,226,134 | 12/1965 | Bridthardt | 282/22 R |
| 3,981,523 | 9/1976 | Maalouf | 282/22 R |
| 4,045,053 | 8/1977 | Carriere | 282/22 R |
| 4,098,947 | 7/1978 | Schmidt et al. | 427/153 |
| 4,126,334 | 11/1978 | Van Malderghem | 282/22 R |
| 4,143,891 | 3/1979 | Neubauer | 427/153 |
| 4,248,919 | 2/1981 | Davis | 282/28 R |

*Primary Examiner*—Paul A. Bell
*Assistant Examiner*—Paul M. Heyrana, Sr.
*Attorney, Agent, or Firm*—Dressler, Goldsmith, Shore, Sutker & Milnamow, Ltd.

[57] ABSTRACT

A tamper-resisting negotiable instrument, its method of manufacture and use are disclosed. The instrument includes a stack of webs comprising a substantially transparent first web having one surface adapted to receive images; a second, removable web, having an image transferring means the one surface in contact with the one, image receiving surface of the first web; and a third removable web including an area capable of visualizing images on its surface facing the second web. Inscription of an image against the surface of the top web in the stack transfers the image from the image transferring means of the second web to the surface of the first web adapted for receiving images and also to the image visualizing area of the third web. Removal of the second web thereafter permits visual inspection of the transferred images, which are superimposed if there has been no tampering.

11 Claims, 3 Drawing Figures

TAMPER-RESISTING NEGOTIABLE INSTRUMENTS CONTAINING A TRANSPARENT VERIFYING WEB

DESCRIPTION

1. Technical Field

This invention relates to multipart negotiable instruments that are resistant to tampering, and particularly to multipart books of negotiable airline ticket blanks which contain a substantially transparent verifying web.

2. Background Art

Tampering with multipart negotiable instruments, such as checks, drafts, and tickets, such as airline tickets, by altering the amounts or destinations, or other information causes great monetary losses to the enterprises issuing them. Although various proposals have been made to alleviate this problem, they have not been entirely successful.

Substantially all of the efforts in preparing tamper-resisting negotiable instruments have been directed either toward tamper-resisting inks and indicia printed with them or to the construction of the web that comprises the instrument itself, rather than to providing an additional web that can be used to verify the information upon the instrument. Various attempts to solve the post-issuance alteration problem in negotiable instruments and credit card-type applications can be found in U.S. Pat. Nos. 4,143,891, 4,051,295 and 4,092,449.

None of the above art teaches or suggests that a tamper-resisting negotiable instrument can be prepared that contains a separate, verifying web as is described herein.

SUMMARY OF THE INVENTION

According to the present invention, multipart negotiable instruments are prepared that have improved resistance to tampering after images are applied thereto. In one embodiment, the instrument is comprised of a stack of at least a first generally planar, substantially transparent web, a second generally planar web, and a third generally planar web.

The first, substantially transparent web is secured into the instrument and defines a first surface and a second surface. One surface of the first web is adapted for receiving an image transferred from a surface in contact with that image receiving surface and receives the image when a corresponding image is inscribed against the surface of the top web in the stack.

The second web is removably secured within the instrument. The second web also defines a first surface and a second surface, with one surface being in contact with the surface of the first web that is adapted for receiving images. The one surface of the second web that is in contact with the surface of the first web includes an image transferrring means in register with at least a portion of the image receiving surface of the first web.

The image transferrring means is capable of transferring an image to the image receiving surface when the corresponding image is inscribed against the surface of the top web in the stack. The image transferring means comprises a particulate matrix erasably bonded to the second web that is defacable when rubbed with an organic solvent, and is removable when an adhesive tape is applied to the image transferring means and then pulled away.

The third web is removably secured with the first and second webs and is beneath the first and second webs.

The third web defines a first and second surface, with the first surface of the third web facing upwardly.

The first surface of the third web includes an area capable of visualizing an image when a corresponding image is inscribed against the surface of the top web. That image visualizing area is in register with the image receiving surface of the first web and the image transferring means of the second web.

When an image is inscribed against the surface of the top web, a corresponding image is transferred to the image receiving surface of the first web and is formed on at least the visualizing area of the first surface of the third web. The images on the first and third webs so formed are substantially superimposed, and the superimposition of the images is observable when viewed through the first web.

In the particularly preferred embodiments of this invention, the negotiable instrument is a ticket, such as an airline ticket, and the first, second, and third webs correspond respectively to a verifying web, and auditor's coupon web and the ticket blank web.

Methods of preparation of the negotiable instrument of this invention and its use are also disclosed.

The present invention has several benefits and advantages. One advantage is that tamper-resisting multipart negotiable instruments and tickets in particular, can be prepared relatively inexpensively.

Another advantage is that the image formed on a verifying web is superimposable upon the image on the instrument, e.g., ticket, itself so that a person accepting the instrument can quickly and easily determine if the instrument has been altered by looking through the verifying web to see if the images on both the verifying web and the instrument match substantially identically.

One of the benefits of a particularly preferred embodiment of the present invention is that the surface of the negotiable instrument bearing the transferred image faces the surface of the verifying web containing the same image, thereby making tampering with the image on the verifying web difficult because of the difficulty in properly aligning the image on a tampered instrument with that which must be upon the verifying web.

Still further benefits and advantages of this invention will be readily apparent to those skilled in the art from the description of the invention that follows and the embodiments thereof, from the claims and from the accompanying drawings.

BRIEF DESCRIPTION OF THE DRAWINGS

In the accompanying drawings forming a part of the specification, and in which like numerals are employed to designate like parts of the same.

DETAILED DESCRIPTION

This invention can be practiced and used in many different forms. The specification and accompanying drawings disclose a specific example of the invention and the invention is not intended to be limited to the specific example illustrated.

For ease of description, the embodiments of this invention will be described in a normal position of use, and terms such as, upper, lower, above, beneath, top, bottom, contact, register and stacked relation and the like will be used with reference to the normal position of use. It will be understood, however, that the multipart negotiable instruments or tickets of this invention can be manufactured, stored, transported, sold and used in other orientations.

Figure 1:
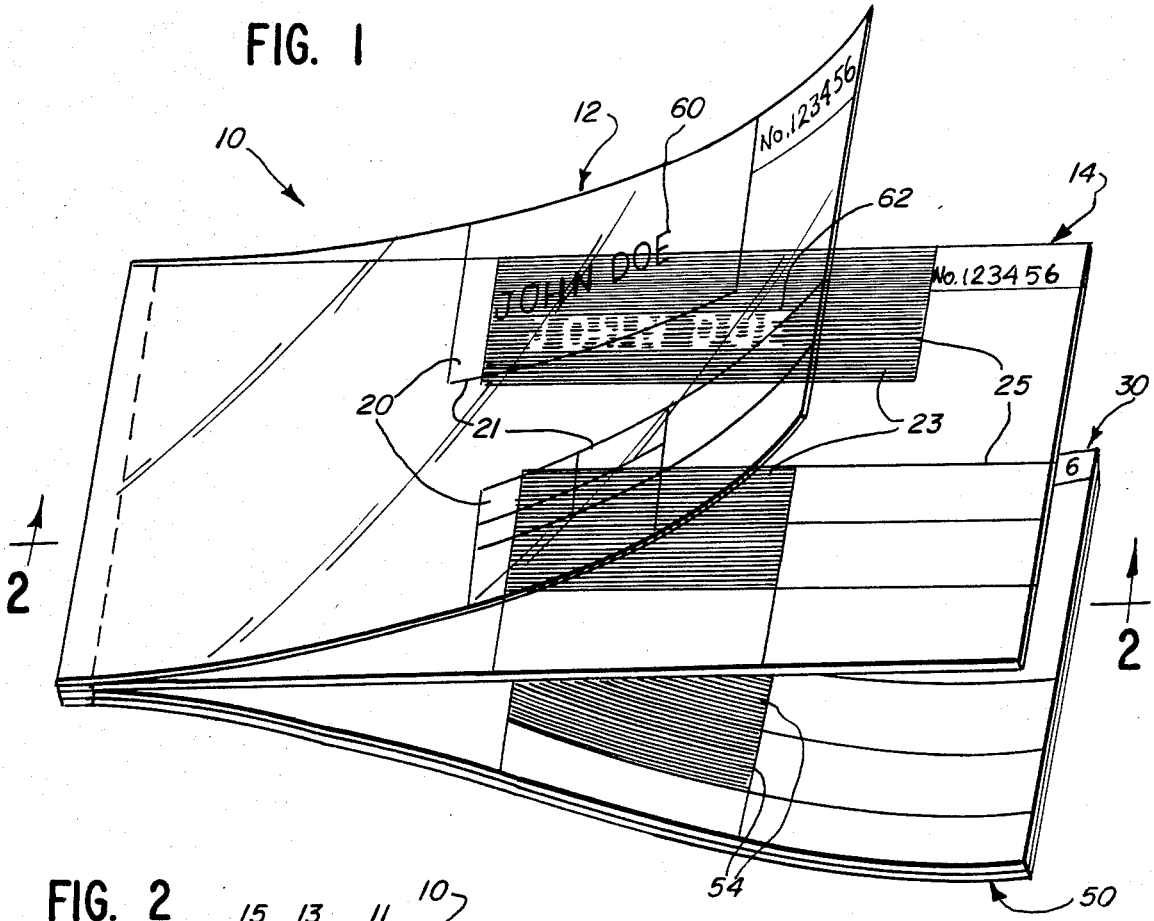
FIG. 1 is a perspective view of a partially inscribed presently preferred embodiment of a multipart ticket of this invention having the verifying web partially folded backward.

FIG. 1 illustrates a multipart negotiable instrument such as a book of airline tickets. Although the further description of the present invention will be made with regard to books of airline tickets, it is apparent that the principles and subject matter disclosed are equally applicable to other multipart negotiable instruments, such as checks, drafts, train and bus tickets, and the like, wherein multiple copies are desired to be prepared from an original without the use of mechanical copying equipment, and particulary where tampering with one or more of the multiple copies is a problem to be anticipated.

Figure 2:
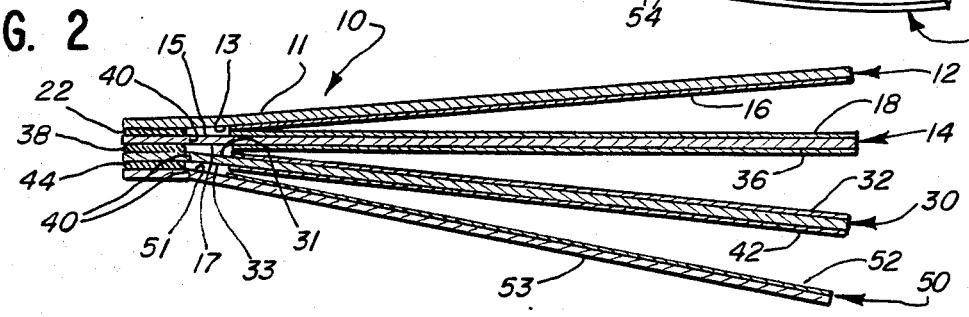
FIG. 2 is an enlarged cross-sectional view of the embodiment of FIG. 1 shown, for ease of illustration, in a partially open position taken along line 2—2.

Referring to FIG. 2, the book of blank tickets 10 according to this invention contains a stack of at least three sheets or webs, namely, a verifying or first web 12 defining a first surface 11 and a second surface 13. One surface of the first web 12 is adapted for receiving images as by image receiving layer 16. The auditor's coupon or second web 14 of the book defines a first surface 15 and a second surface 17. The one surface, such as the first surface 15 of the second web 14, includes an image transferring means 18 disposed thereon and covering at least a selected portion of the first surface 15 of that web.

In preferred practice, the image transferring means 18 may be subdivided into zones or areas 23 from which images may be transferred. The zones 23 are preferably defined by lines or other indicia 25 printed under or over the image transferring means 18. Similar zones 20 for receiving transferred images defined by printed lines 21 are also preferably placed upon the first surface 11 of the verifying web 12.

The ticket blank or third web 30 defines a first surface 31 and a second surface 33. The first surface 31 of the third web 30 includes areas 54 for visualizing images that are preferably defined by lines or other indicia 56 printed over or under the visualizing area 54.

Figure 3:
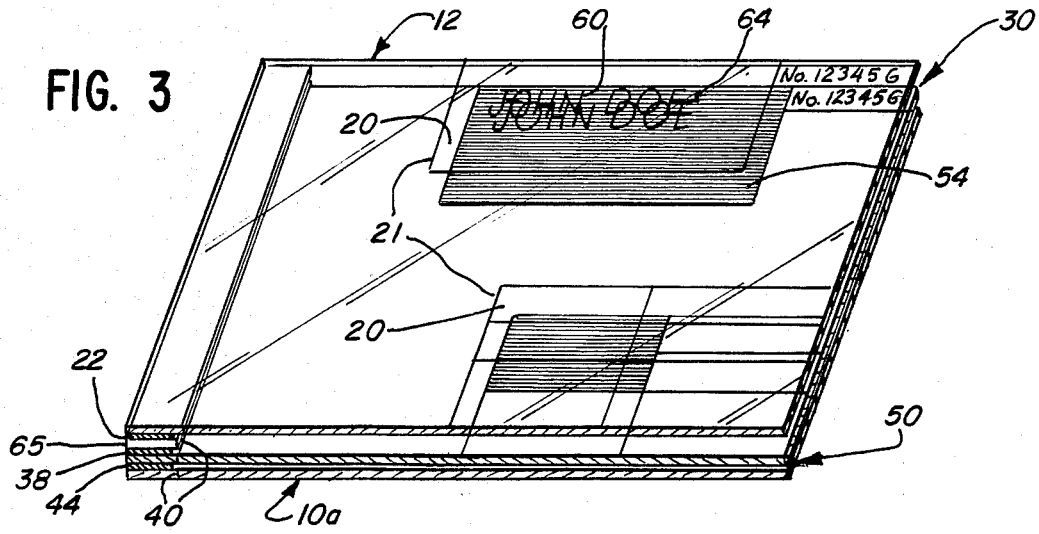
FIG. 3 is a perspective view of the partially inscribed embodiment of FIG. 1 from which the second web has been removed, and shown, for ease of illustration, with the space enlarged between the first and third webs.

A fourth web 50 on the bottom of the stack, which is a second ticket blank web, is also shown in FIG. 2, as well as in FIGS. 1 and 3. The fourth web 50 also defines a first surface 51 and a second surface 53. The first surface 51 is preferably substantially identical to the first surface 31 of the third web 30, and includes areas for visualizing images (not shown) that are similar to the visualizing areas 54 of the third web and are preferably defined by lines or other indicia (not shown) printed over or under the visualizing area.

When more than two ticket blank webs are present in the book of ticket blanks, the bottom most ticket blank web will generally resemble the fourth web 50 shown in FIG. 2. The ticket blank webs between the bottom most web and the auditor's coupon web 14 resemble the third web 30 shown in FIG. 2.

The first web 12, the second web 14, and the third web 30 are stacked and secured within the negotiable instrument. The stack has a top web and a bottom web and is preferably made into book form by any convenient means such as by adhesive layers 22 and 38. Additional ticket blank webs such as web 50 or other webs (not shown) may be included in the negotiable instrument, and are secured therein by similar means, such as adhesive layer 44.

In preferred practice, the auditor's coupon web 14 and the ticket blanks such as web 30 are removable from the book along a line of perforations 40. Additional webs may also be removable from the instrument. It is particularly preferred that the verifying web 12 not be readily removable from the instrument so that it will remain with the issued ticket and can be used for its verifying purpose.

The verifying web 12 is substantially transparent, and one surface, such as its second surface 13, is adapted to receive images tranferred from a surface in contact with the image receiving surface when a corresponding image is inscribed against the surface of the top web in the stack. In preferred practice, the second surface verifying web is adapted to receive images by including a substantially transparent layer 16 of an image receiving substance.

As used herein, the phrase "substantially transparent" is meant to include both transparency and translucency. A substantially transparent verifying web of this invention will permit sight of images upon the ticket blank when the verifying web is placed thereover.

The verifying web 12 may be prepared from a variety of substantially transparent materials. Included among these materials are substantially clear plastics such as polyethlene, polypropylene, and polyethlene terephthalate. Paper-derived webs are particularly preferred and include glassine and tracing papers as well as tissue paper and the like. Tissue paper having a weight of about 20 to about 30 pounds per ream of 24 inch by 36 inch paper is particularly preferred for use as the verifying web.

When the particularly preferred paper-derived webs are used as the verifying web 12, it is helpful to include an image receiving layer 16 on the second surface 13 to promote transfer of the image, and retention of the transferred image on the image receiving surface. The image receiving layer 16 of the verifying web 12 is preferably composed of a waxy substance.

A particularly preferred waxy substance is a mixture of relatively soft, low melting point microcrystalline waxes, paraffin waxes and oxidized homopolyethylene. The useful microcrystalline waxes have typical melting point ranges of about 160° F. to about 185° F. and have needle penetration values of about 20 to about 85. The paraffin waxes typically have a melting point range of about 135° F. to about 155° F., while the oxidized homopolyethylene melts in the range of about 215° F. to about 255° F.

The microcrystalline waxes are typically present at about 45 to about 75 weight percent of the waxy substance, with the paraffin wax typically being present at about 20 to about 40 weight percent and the oxidized homopolyethylene being present at about 2 to about 8 weight percent. Additional materials such as plasticizers and fillers may also be present.

A particularly preferred waxy substance comprising the image receiving layer 16 typically has a congealing point in the range of about 155° F. to about 175° F., with a melting point range of about 165° F. to about 185° F. A useful, particularly preferred waxy substance is available from Frye Copysystems, Inc. of Des Moines, Ia. and is sold under the trademark IMPACT CF coating.

The particularly preferred waxy substance is coated onto the verifying web at a temperature of about 200° F. to about 235° F. using standard coating methods. Use of a coating temperature at least about 15° F. above the melting temperature of the waxy substance permits penetration of the waxy layer into the verifying web.

The waxy coating is preferably applied in an amount to provide a layer 16 weighing about 0.7 to about 1.3 pounds per ream of 20 inch by 30 inch paper, where the entire surface of the paper is coated.

Coating weights below the preferred amounts usually result in broken images upon transfer from the image transferring means 18. Coating weights above the preferred amount can be used, but provide a substantially continuous waxy film on the verifying web which tends to prohibit penetration and drying of subsequently applied printing inks.

Coating of the image receiving layer 16 in the above, preferred range, provides a layer 16 which is slightly discontinuous and permits penetration of subsequently applied printing inks into the verifying web stock for drying purposes. Viewing of a verifying web so prepared in the light shows hills and valleys of the coating that comprises the image receiving layer 16.

The remaining webs of the books 10 can be made from various papers and synthetic fibers as known in the art for the preparation of tickets and other multipart negotiable instruments. In preferred practice, the webs are paper, and the surfaces of the paper are hardened and smoothed as desired with conventional sizings and or by calendering. The hardening assists in retarding penetration of the various layers that are subsequently applied to the surfaces of the webs.

The smoothness of the preferred paper webs can differ from one surface of the web to the other, and can be specified in units of microinches by a surface smoothness indicator in accordance with the standard paper industry smoothness measurements. In preferred practice, both surfaces may have a smoothness of about 35 microinches to about 100 microinches. In more preferred practice the paper web surface of the auditor's coupon web 14 that includes the image tranferring means 18 may have a surface smoothness of about 50 micro inches to about 85 microinches. Surface smoothness can be measured using a Gould SURFANALYZER 7100 model 21-01200-00 manufactured by Gould, Inc. of Rolling Meadows, Ill.

The image transferrring means 18 of the auditor's coupon web 14 comprises a particulate matrix. The particulate matrix can itself be comprised of a number of solid materials that are insoluble or substantially insoluble in water and organic solvents. Exemplary particulate materials include usual inorganic pigments and fillers such as titanium dioxide, zinc oxide, silica, calcium carbonate, calcium sulfate, and the like and mixtures thereof. The choice of fillers can be made to vary the opacity of the ultimately formed, transferred image.

The particles are ground to a fine consistancy so that they can be preferably printed flexographically upon the surface of the auditor's coupon web 14. A useful average particle size is about 15 to about 16 microns for the largest dimension. Preferably, the average particle size is about 5 to about 6 using North Standard Measurements of of particle size which correspond to particles having an average largest dimension of about 25 to about 40 microns.

The particulate matrix is erasably bonded to the second web 14 by an organic polymer that can be soluble or dispersible in organic solvent or in water or mixtures thereof. Exemplary organic polymers include polyvinyl butyral resin, acrylic ester homopolymers and copolymers, such as those of acrylic acid and methacrylic acid esters of $C_1$–$C_8$ alcohols polymerized with themselves as well as with other monomers such as styrene, acrylic acid, methacyrlic acid, maleic acid, acrylamide, methacrylamide and N-substituted $C_1$–$C_8$ derivatives thereof.

As is known in the latex paint art, polymers that contain acidic groups can be made water soluble or dispersible by at least partial neutralization of the acid groups with an inorganic base such as sodium hydroxide, amines such as ammonia or ethanolamine and the like. In addition, water solubility and dispersibility can also be improved by copolymerization of monomers that contain hydroxyl groups such as 2-hydroxylethyl acrylate or N-(2-hydroxylethyl) methacrylamide. Polyvinyl butyral resins are particularly preferred.

The image transferring layer 18 can be applied to the web by lithographic, gravure, flexographic, or similar printing techniques.

In preferred practice, the weight ratio of organic solvent-soluble polymer to that of the particulate matrix in the preferred flexographic-type ink is about 1:3 to about 1:5.

It is preferred that the polymer be dissolved or dispersed in an organic solvent, and the phrase "organic solvent" will be used illustratively hereinafter with the understanding that water, admixtures of water with an organic solvent are also useful. The words "soluble" and "dissolved" will be used for convenience hereafter to include materials that are soluble or dispersible, and dissolved or dispersed, respectively.

As noted above, the image transferring means is preferably flexographically printed onto the auditor's coupon web 14. To that end, the particulate matrix and bonding polymer are dissolved in a suitable solvent to form a flexographic-type ink.

The phrase "organic solvent" is used herein to include usual liquid solvents of low molecular weight (less than about 250 Daltons). Typically useful organic solvents for the flexographic ink include hydrocarbon solvents such as hexane and benzene, ketones such as acetone and methyl ethyl ketone, and esters such as ethyl acetate and butyl acetate, chlorocarbons such as trichloroethylene, trichloroethane and chloroform, as well as alcohols such as methanol, ethanol, and the like. In addition, mixed organic solvents, such as lacquer thinner and mineral spirits as well as mixtures of the above solvents fall within the definition "organic solvent" as used herein. A particularly preferred organic solvent is ethanol.

The organic solvent is preferably used in a volume, which if anhydrous ethanol, would comprise about 40 to about 60 weight percent of the total flexographic-type ink used for making the image tranferring means 18. More preferably, the volume of organic solvent comprises about 45 to about 55 weight percent of the flexographic-type ink, as asbolute ethanol.

The amounts of the above ingredients comprising the preferred flexographic-type ink used to prepare the image tranferrring means 18 are easily adjusted to provide a coating, after drying at a 150° F., of about 1.25 to about 1.55 pounds per ream of coated paper; the paper measuring 20 inches by 30 inches. In more preferred practice, the amount of image transferring means after drying is about 1.3 to about 1.45 pounds per ream calculated upon the area the web covered with the transferring means. That desired amount is typically obtainable from a composition that has a viscosity using Zahn No. 2 conditions at 70° F. (21° C.) of about 50 to about 65 seconds.

A flexographic ink suitable for use in preparing the image transferring means 18 is available from Frye Copysystems, Inc. under the trademark IMPACT CB coating. It is noted that the combination of an opaque paper web coated on one side with a layer the IMPACT CB coating and a second opaque paper web coated with the beformentioned IMPACT CF coating has been used for transferring images in so-called "carbonless" copying. However, that use does not include transfer of an image to a substantially transparent web for the purpose of verifying the correctness of transferred images on webs therebelow by superimposition of the webs and their transferred images.

It is also noted that the image transferring means 18 need not cover the entire surface of the auditor's coupon web upon which it is applied. In preferred practice, the image transferring means 18 covers at least a portion of the first surface of the auditor's coupon web 14, e.g., for tickets, that portion containing points of origin and destination as well as the area wherein the cost of the trip is inscribed.

The image transferring means 18 may be further characterized in that after its application and drying, it may be defaced and also stained by light, fingertip rubbing with organic solvents such as those useful for preparing the flexographic ink. The image transferring means also demonstrates defacement when liquid water is lightly rubbed upon its surface, although the layers are preferably somewhat sensitive to water than to organic solvents to permit ease of usage under conditions of high relative humidity. The image transferring means is also removable from the auditor's coupon when rubbed with a pencil eraser.

The image transferring means 18 is also removable from the web surface when an adhesive tape having a bond strength to steel of about 5 ounces per linear inch (about 5.5 Newtons per 100 millimeters) is applied and then pulled away therefrom under conditions of Federal Test Methods Standard 147c. Substantial removal of the image transferring means can be effected by an adhesive tape having a bond strength steel of about 6 ounces per foot (about 7 Newtons per 100 millimeters) and subsequent pulling of the tape away from the surface of the image transferring means, using the above test conditions.

When less than the above amounts of image transferring means material is applied to the web surface, transfer of an image to the image receiving surface of the verifying web 12 can be impaired. When greater than the above amounts of image transferring material is applied to the auditor's coupon web, the image transferring means tends to crack or flake off prematurely, and much of the flexibility of the image transferring means is lost.

As noted previously, the one surface 15 of the auditor's coupon web 14 including the image transferring means 18 may define zones or areas 23 from which the images are transferred. Those zones 23 are defined by indicia 25 applied at least in part over or under the image transferring means. The indicia 25 can be applied by conventional printing techniques such as offset and lithographic printing, using standard printing means.

Tamper-resisting indicia such as colors, a pattern of lines (as shown in zones 23) or spots can also be printed over the image transferring means, and can be transferred with the image to the verifying web to further reduce the chances of tampering with an issued ticket. Thus, the transferred image will contain a portion of the tamper-resisting indicia originally present on image transferring means of the auditor's coupon. The image transferring means can also include colored and/or luminescent dyes or pigments to further reduce the chances of successful tampering with an issued ticket.

The negotiable instrument or ticket blank web 30 (50) includes an area 54 capable of visualizing an image when a corresponding image is inscribed against the surface of the top web in the stack, with the image visualizing area 54 being in register with the image transferring means of the second surface of the second web. The image visualizing area 54 can be a plain or treated paper surface, or can include a conventional microencapsulated ink, or the like as are used in negotiable instruments and tickets. The image visualizing area 54 can also be comprised of a separate, visualizing, tamper-resistant coating 32 (52).

In usual practice, an image is visualized in the visualizing area 54 of the ticket blank 30 by means of a image transferring layer 36 (42) on the second surface 17 of the auditor's coupon web 14 (or on the second surface 33 another web 30) in contact with the ticket blank web 30 (50) in the book of negotiable instruments. The image transferring layer 36 can be comprised of any one of a number of well-known transferring substances.

The important feature of an image transferring layer 36 is that it transfers an image to the image visualizing area 54 when those layers are in contact with each other and a corresponding image is inscribed as by writing with a ballpoint pen, pencil or by typewriter upon the first surface of the verifying web, or on a surface or web that overlies the web bearing the image transferring layer.

The word "inscribed" in its various grammatical forms as used herein to mean a sufficient amount of pressure is applied directly or indirectly to the surface of the top web in the stack, such as the first surface 11 of the first web 12, so that an image corresponding to the inscribed image can be transferred from the image transferring means 18 on the second web 14 to the surface 13 of the verifying web 12, and also downwardly to the ticket blank web 30, below the first and second web. Normal pressures used in writing with a ballpoint pen, pencil or typewriter are sufficient for that inscribing.

Included among the suitable materials comprising the layer for transferring images are commonly used carbon-containing coatings, and microencapsulated inks. Thus, substantially any material that can be transferred by inscription from one surface and be retained by the image visualizing area 54 is suitable.

In preferred practice, the image transferring layer is made from a substance comprised of a colorant-medium dispersion; i.e., the colorant such as a dye or pigment, dispersed in a hydrophobic. Suitable colorants include barium lithol, carbon black and methylviolet oleate. Exemplary hydrophobic media include carnauba wax, beeswax, paraffin waxes, and the like, or mixtures thereof. The waxes can also be used alone as well in combination with naturally occurring or synthetic oils, such as mineral oil, which serve to plasticize or soften them. In addition, fillers such as kaolin, petrolite and the like may also be present in the colorant-medium dispersion.

The image transferring layer 36 (42) should be softer than the surface of the image visualizing area 54. Generally, the hardness or the final image transferring layer can be pretested by making penetrometer determination upon a block or other flat-surface shape of the substance comprising the image transferring layer 36.

In preferred practice, an image transferring substance exhibits a penetrometer reading (in units of 0.1 millimeter), more than about 5 and less than about 30 units. In more preferred practice, the pemetrometer reading is about 10 to about 20 units. In most preferred practice, the penetrometer readings are about 14 to about 18 units. An Universal Penetrometer with a 50 gram applied load for a total load of 100 grams, and a dwell time of about 5 seconds is used for these measurements.

The image transferring substance is applied as a coating to at least a portion of the desired web surface by coating methods known in the art, such as from a solvent dispersion or a melt, to form the image transferring layer 36 (42). The coating is suitably applied to the web surface in an amount to provide an image transferring layer 36 (42) at about 0.8 to about 4 pounds per ream of 20 inch by 30 inch paper after drying. In preferred practice, the image transferring substance is applied to the paper in an amount of about 1 to about 2.5 pounds per ream.

In another embodiment of this invention (not shown), the relative positions of the second, auditor's coupon web 14 and the first, verifying web 12 are reversed relative to the ticket blank webs 30 (50) therebelow in the stack; i.e., the auditor's coupon web 14 is above the verifying web 12 in the stack of webs comprising the book. In this embodiment, the image transferring means 18 of the auditor's coupon web 14 remains in contact with the one surface 13 of the verifying web 12 that is adapted to receive images, as by the presence of the image receiving layer 16. The image 60 transferred to the verifying web 12 is on the top surface of that web rather than being on the under surface as is shown in FIG. 2.

In this embodiment, the image 64 that is visualized on the ticket blank web 30 can be visualized by means of (i) a conventional "carbon paper" inserted between the verifying web 12 and the ticket blank web 30, (ii) conventional "carbonless" copying techniques utilizing microencapsulated inks, (iii) a colored, but nevertheless transparent, transferable coating placed on the surface of the verifying web 12 opposite the surface 13 adapted for receiving images, or the like. The image transferring layer 36 on the second surface 17 of the auditor's coupon web 14 need not be present.

To prepare ticket blank book 10 of the instant invention, a first substantially transparent, generally planar web 12 defining a first surface 13 and a second surface 15 is provided, the second surface being adapted for receiving a transferred image. In particularly preferred practice, a coating of image receiving layer 16 is preapplied to at least a selected portion of the second surface 13 of that first web in an amount sufficient to receive an image transferred from a surface in contact with the image receiving layer when a corresponding image is inscribed against a surface of the top web in the stack.

A second generally planar web 14 defining a first surface 15 and a second surface 17 is also provided. A coating of image transferring material is applied to at least a portion of one surface of that second web, as by flexographic printing, to form an image transferring means 18; that image transferring means comprises the above-described particulate matrix that is erasably bonded to that web surface.

A third web 30 defining a first surface 31 and a second surface 33 is also provided. The first surface 31 of that third web 30 includes an area 54 capable of visualizing an image when a corresponding image is inscribed against a surface of the top web.

The first, second and third webs are placed in stacked relation so that the one surface adapted to receive images of the first web and the one surface of the second web bearing the image transferring means are in contact. The third web is positioned below the first and second webs in the stack. The image visualizing area of the third web is positioned to face upwardly and is in register with the image transferring means 18 of the second web 14, thereby providing for superimposition of images transferred to and received by the surface of the first web 12, and visualized by the visualizing area 54 on the first surface 31 of the third web 30. The webs are then secured together as by an adhesive.

The second and third webs are preferably made removable from the book of ticket blanks by providing score lines 40 in the webs at the desired locations prior to incorporation of those webs into the book of ticket blanks.

When the ticket blank books of this invention include an auditor's coupon having an image transferring layer 36 on its second surface 17, it is preferred that the image transferring means 18 be first coated on the web and dried to the touch prior to the application of the image transferring layer 36. Printing of indicia 25 over the surface of the image transferring layer and thereby covering at least a portion of that layer follows thereafter, followed by coating the image transferring layer on the second surface thereof.

The ticket blank books provide improved resistance to tampering after the ticket or instrument is issued. An image is inscribed against the surface of the top web, such as the first surface 11 of the verifying web 12, transferring the inscribed image from the image transferring means 18 on the first surface 31 of the auditor's coupon 30 to the second surface 13 of the verifying web 12. That image so transferred is a positive image 60 (FIGS. 1 and 3), leaving a negative image 62 (FIG. 1) on the auditor's coupon. The same act of inscription transfers the corresponding image from the image transferring layer 36 (42) to the visualizing area 54 of the ticket blank web 30 (50) when all of the webs are in contact and in register. The image 64 transferred to the ticket blank web is also typically a positive image, although negative imagery can also be used. The auditor's coupon 14 is thereafter removed from the book of ticket blanks 10, leaving a stub 65 in the book 10*a*, and the ticket is issued.

It is noted that in discussing transfer and receipt of images, reference has been made to inscription against the surface of the top web in the stack. It is to be understood that the reference to inscription against the surface of the top web is made for convenience, and that the inscription may be made against the surface of the bottom web in the stack with the same result. Inscription against the surface of the top web is also meant to include situations in which one or more webs are above the verifying web in the stack.

It is further noted that the phrase "inscribed against" in its various grammatical forms has been used herein rather than the phrase "inscribed upon". Thus, while an image may be inscribed upon the surface of the top web, e.g. the verifying web, an image need not appear upon that surface, and preferably does not so appear when the top web is the verifying web. Rather, the image on the verifying web 12 is a transferred, positive image 60 which appears upon the image receiving surface of that web.

After the ticket has been issued, one may check it for tampering by observing the superimposition of the images on the verifying web 12 and in the visualizing area 54 ticket 30 (50) therebelow. If the ticket is unaltered, the images on both webs are substantially identical and substantially superimposable. If the ticket has been tampered with, the person checking the tickets should be able to make that determination by the lack of superimposition of the various images that are upon the two webs by looking through the verifying web.

The invention is further illustrated by the examples which follow.

BEST MODE FOR CARRYING OUT THE INVENTION

Example 1: Book of Airline Ticket Blanks

A book of negotiable airline ticket blanks according to this invention was prepared as follows.

The verifying web was prepared from a roll of tissue paper having a weight of 25 pounds per ream when cut into pieces 24 by 36 inches square. This paper is available from Rinelander Paper Company, of Rinelander, Wisc. under the trademark RINLANDER X-2501 translucent paper. The specifications for this paper include a tear force of 12 grams in the machine direction and 14 grams across the machine direction; an opacity of 29 percent and a transparency of 65. Opacity percentages were measured using a Diano-BN 1-2 Opacimeter manufactured by Diano Corporation of Woburn, Mass. Transparency was measured using a Martin Sweets Transparency Tester, manufactured by the Martin Sweets Company, Inc., of Louisville, Ky., and designed by the Glassine and Greaseproof Manufacturers Association. The paper averages a thickness of 1.8 mils.

The tissue paper was coated on one surface with a waxy substance that is a mixture of microcrystalline waxes, paraffin waxes and oxidized homopolyethylene sold under the trademark IMPACT CF coating by Frye Copysystems, Inc. of Des Moines, Ia. This material was discussed in greater detail hereinbefore.

The tissue paper was roller coated with the waxy substance, with the waxy substance at a temperature of about 200° F. to about 235° F., to provide a layer adapted to receive images on the second surface of the tissue paper. The layer so applied weighed about 0.7 to about 1.3 pounds per ream of 20 by 30 inch tissue paper.

After the waxy substance layer had solidified, the first surface of the coated tissue paper was printed with lines to define zones for receiving transferred images. The coated and printed tissue paper was then cut to size for use as a verifying web.

Auditor's coupons useful in a book of ticket blanks of this invention were prepared from a white roll of calendered paper having a smoothness of about 80 microinches on one surface and a smoothness of about 60 microinches on the other surface. The image transferring means was applied on a selected area on the 80 microinch surface by flexographically printing a dispersion of North Standard size 5–6 particles and polyvinyl butyral resin in organic solvent. The weight ratio of particles to copolymer to solvent was about 21:5:24, with the solvent comprising a mixture of ethanol and ethyl acetate in a weight ratio of about 13:1, respectively. The dispersion had a Zahn No. 2 viscosity of 57 seconds at 21° C. (about 70° F.). Total solids content of the dispersion was about 54 percent by weight and included small amounts of plasticizing oils. The image transferring means was applied at an average generally uniform coverage of 1.3–1.45 pounds per ream, after drying at 150° F. The flexographically applied image transferring coating used was the previously described IMPACT CB coating available from Frye Copysystems, Inc.

The surface bearing the image receiving layer was then further overprinted with lines to define zones for receiving images and with other airline ticket indicia. That printing was then dried.

A dispersion of barium lithol as colorant, carnauba wax and plasticizing oils as hydropholic medium was further dispersed in trichloroethylene, and thereafter applied on the surface of the above coated paper having a smoothness value of 60 microinches to provide an image transfer layer on the second surface of the auditor's coupon. Penetrometer readings on blocks of the colorant-medium dispersion prior to further dispersion in trichloroethylene averaged 14 to 18. After drying, it was determined that the material of the image transferring layer had been applied at an average generally uniform coverage in excess of 1 pound per ream.

After the material comprising the image transfering layer had dried, the paper was perforated, and was cut into webs of the desired size, leaving about one-half inch between the perforations and one edge of the web.

Two types of additional webs cut to the same size as the verifying and auditor's coupon webs were also prepared. The first additional web was a ticket blank and included perforations, printed lines and airline ticket indicia on the 80 microinch surface to comprise the image visualizing area, and the image transferring layer, prepared as described before, on the 60 microinch surface. The second additional web was a second ticket blank web that included perforations and printed lines and airline ticket indicia on the first surface, applied as described before, to form the image visualizing area.

The above prepared webs were then assembled into a stack having the verifying web on top and the auditor's coupon immediately below it, with the waxy substance layer of the verifying web in contact with the surface of the auditor's coupon web bearing the layer of image transferring means. The ticket blank web bearing both an image visualizing area and an image transferring layer was placed below the auditor's coupon web, with the surface bearing the image visualizing area in contact with the image transferring layer of the auditor's coupon. The ticket blank web having no image transferring layer was placed into the stack at the bottom most web, with its image visualizing area in contact with the image transferring layer of the ticket blank web above it in the stack.

The zone for receiving transferred images of the verifying web, the zone for transferring images of the auditor's coupon web and the areas for visualizing images of the ticket blank webs were aligned and registered. Adhesive was then placed between the webs in the area defined by the perforations and adjacent edges of the lower three webs, and the four webs were thereby glued together to form a book of negotiable ticket blanks of this invention.

An image was then inscribed against the surface of the verifying web opposite the image receiving layer and within the zone for receiving transferred images. That inscription transferred the image from the transferring means to the image receiving layer and also from the image transferring layers of the auditor's coupon web and the ticket blank web immediately below it onto the webs below those respective webs in the stack. The auditor's coupon web was removed along the line of perforations provided to that web to produce a ticket book in "issued" form.

Viewing of the "issued" ticket book through the verifying web showed that the images on the verifying web and the ticket web therebelow were superimposed. The ticket web below the verifying web was removed, along the lines of perforation of that ticket web, to thereby place the second ticket immediately below the verifying web. Viewing of the second "issued" ticket through the verifying web again showed that the images transferred to each web were superimposed.

Example 2: Transfer Means Properties

Sample webs were prepared substantially similar to the auditor's coupon of Example 1, with a green dye being printed over the image transferring material, and thereby to the image transferring means. The green dye emits a yellow color under ultraviolet light. The sample webs were conditioned at 73° F. and 50 percent relative humidity for 48 hours in a convection oven prior to making the examinations. The results were as follows:

| | Observations |
|---|---|
| Application Of The Indicated Material Followed By Light Rubbing With The Index Finger | |
| Ethanol, Lacquer Thinner Acetone, Toluene, Trichloroethane | The green printing smeared and defaced when wet; permanent stain on drying was observed. |
| Mineral Spirits | The green printing rubbed off when the layer was wet; permanent stain on drying was observed. |
| Iso-propanol | The green printing smeared and defaced when the layer was wet; permanent stain on drying was observed. |
| Water, Soapy Water, Vinegar | Severe rub-off of printing; permanent stain on drying was observed. |
| Erasure By A Common Pencil Lead Eraser | Severe rub-off of green printing to the underlying white sized paper was observed, which was observable under ultraviolet light as a dull violet color contrasting with the brilliant yellow exhibited by the green zone. |
| Application Of SCOTCH Brand Adhesive Tape Over The Green Layer | When the tape was pulled off slowly, it removed the green layer and revealed the underlying white sized paper which was observable under ultraviolet light as a dull violet color contrasting with the brilliant yellow exhibited by the green zone. |

The foregoing results show (1) the solvents and chemicals commonly used to alter airline tickets severely defaced the ticket surface by permanent staining or smearing of the image receiving layer; (2) the stains and defaced areas were very visible as dull violet discolorations under ultra-violet light and frequently as white areas by the naked eye, and (3) those physical properties provide readily discernible evidence to indicate that there was an attempt to alter the subject matter in the image receiving layer of the ticket.

Webs that would be useful for receiving transferred images in negotiable instruments were quantitatively compared for their resistance to successful tampering by means of erasure.

From the foregoing, it will be observed that numerous variations and modifications can be effected without departing from the true spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

What is claimed is:

1. A multipart negotiable instrument having improved resistance to tampering after inscription of an image thereon, said instrument comprising in stacked relation at least a first generally planar, substantially transparent web, a second generally planar web and a third generally planar web;

said first substantially transparent web being secured to said instrument and defining a first surface and a second surface, one of said surfaces adapted for receiving an image transferred from a surface in contact with said one surface when a corresponding image is inscribed against the surface of the top web in said stack;

said second web being removably secured to said instrument, and defining a first surface and a second surface, one of said surfaces being in contact with said one surface of said first web that is adapted for receiving images, said one surface of said second web including an image transferring means in register with at least a portion of said first web and capable of transferring an image to said one surface of said first web when a corresponding image is inscribed against a surface of said top web;

said image transferring means comprising a particulate matrix erasably bonded to said one surface of the second web and defacable when rubbed with an organic solvent, said means also being removable when an adhesive tape is applied to said image transferring means and then pulled away; and said third web being removably secured to said instrument beneath the first and second webs in said stack and defining a first surface and a second surface, the first surface of said third web facing upwardly and including an area capable of visualizing an image when a corresponding image is inscribed against the surface of said top web, said image visualizing area being in register with the image transferring means of said first surface of said second web.

2. A multipart negotiable instrument in accordance with claim 1 comprising a book of ticket blanks.

3. A multipart negotiable instrument in accordance with claim 1 wherein said first web is above the second web in said stack.

4. A multipart negotiable instrument in accordance with claim 3 wherein the second surface of said second web includes an image transferring layer in register with the image transferring means on the first surface of said second web, said image transferring layer being capable of transferring an image that is visualized in the visualizing area of said third web.

5. A book of negotiable instrument ticket blanks comprising at least one, generally planar, substantially transparent verifying web for receiving images inscribed on a ticket blank, at least one generally planar auditor's coupon web for transferrring images inscribed on a ticket blank to said verifying web, and at least one ticket blank web, said webs secured in said book in stacked, registered relation;

said verifying web defining a first and a second surface, said second surface including a substantially transparent layer for receiving an image transferred from a surface in contact with the image receiving layer when a corresponding image is inscribed against the first surface of said verifying web in said book;

said auditor's coupon web defining a first and a second surface, and being removable from said book, said first surface being in contact with the second surface of said verifying web, said first surface including an image transferring means in register with said image receiving layer of said first web and capable of transferring an image to said receiving layer when a corresponding image is inscribed against the first surface of said verifying web, said image transferring means comprising a particulate matrix erasably bonded to the second web and defacable when rubbed with an organic solvent, said means being removable when an adhesive tape is applied to said image transferring means and then pulled away;

said ticket blank web being beneath said first and second webs and defining a first and a second surface, said first surface facing the second surface of said auditor's coupon and including an area capable of visualizing an image when a corresponding image is inscribed against the first surface of said verifying web, said image visualizing area being in register with the image receiving layer of the visualizing web and the image transferring means of the auditor's coupon.

6. A book of negotiable instrument ticket blanks in accordance with claim 5 wherein said adhesive tape has a bond strength to steel of at least about 5 ounces per linear inch.

7. A book of negotiable instrument ticket blanks in accordance with claim 5 wherein the second surface of said auditor's coupon web includes an image transferring layer in register with the image transferring means on the first surface of said auditor's coupon, said image transferring layer being capable of transferring an image that is visualized in the visualizing area of said ticket blank web.

8. A book of negotiable instrument ticket blanks in accordance with claim 7 wherein said image transferring layer of said auditor's coupon web comprises a colorant dispersed in a hydrophobic medium, the colorant-medium dispersion of said transferring layer having a penetrometer value of about 5 to about 30 when in the form of a block prior to formation of said layer, the image visualizing area of said third web being at least partially in contact with said image transferring layer when an image is to be transferred therebetween.

9. A book of negotiable instrument ticket blanks in accordance with claim 5 wherein the image receiving layer on the second surface of said verifying web comprises a coating of a waxy substance.

10. A book of negotiable instrument ticket blanks in accordance with claim 9 wherein said waxy substance includes a mixture of relatively soft, low melting point microcrystalline waxes, paraffin waxes and oxidized homopolyethylene.

11. A method of using a book of negotiable ticket blanks to provide improved assistance to tampering after a ticket of said book is issued comprising the steps of:

(a) providing the book of negotiable ticket blanks of claim 5;

(b) inscribing an image against the first surface of the verifying web of said book and thereby forming substantially superimposable images on (i) the second surface of said verifying web, (ii) the first surface of the auditor's coupon web and (iii) on the first surface of the ticket blank web;

(c) thereafter removing said auditor's coupon;

(d) issuing the ticket book so prepared; and (e) viewing the issued ticket book through the verifying web to observe the superimposition of the images on the webs.

* * * * *